US007338313B2

(12) United States Patent
Fekonja et al.

(10) Patent No.: US 7,338,313 B2
(45) Date of Patent: Mar. 4, 2008

(54) MOTOR-VEHICLE ELECTRICAL CONNECTOR ASSEMBLY

(75) Inventors: Rudolf Fekonja, Munich (DE); Michael Respondek, Mengkofen (DE); Arnold Federer, Götzis (AT); Kurt Ellensohn, Götzis (AT); Georg Geismayr, Weiler (AT)

(73) Assignee: Hirschmann Automotive GmbH, Rankweil/Brederis (AT)

( * ) Notice: Subject to any disclaimer, the term of this patent is extended or adjusted under 35 U.S.C. 154(b) by 0 days.

(21) Appl. No.: 11/728,581

(22) Filed: Mar. 26, 2007

(65) Prior Publication Data

US 2007/0298648 A1 Dec. 27, 2007

(30) Foreign Application Priority Data

Mar. 24, 2006 (DE) ..... 10 2006 014 156

(51) Int. Cl.
*H01R 12/24* (2006.01)

(52) U.S. Cl. ..... 439/495; 439/930

(58) Field of Classification Search ..... 439/877, 439/878, 930, 495, 739, 743, 744, 749
See application file for complete search history.

(56) References Cited

U.S. PATENT DOCUMENTS 4,221,446 A * 9/1980 Niles et al. ..... 439/291
5,015,197 A * 5/1991 Redmond et al. ..... 439/329
6,210,210 B1 * 4/2001 Kozel et al. ..... 439/495

* cited by examiner

*Primary Examiner*—Tho D. Ta
(74) *Attorney, Agent, or Firm*—Andrew Wilford

(57) ABSTRACT

A wire having a conductive core surrounded by an insulation sheath is fitted to an electrical connector having a housing formed with a longitudinally extending passage and a contact part in the passage. The contact part has a front end having pair of sides adapted to flank a contact pin engaged in the passage and a rear end adapted to grip the wire with a stripped end of the conductive core extending in the front end between the sides thereof alongside the pin. An anchor lug on one of the sides engages an inner surface of the passage and retains the contact part therein. A biasing element braced between the conductive core and an opposite inner surface of the passage presses the conductive core transversely against the pin.

11 Claims, 3 Drawing Sheets

MOTOR-VEHICLE ELECTRICAL CONNECTOR ASSEMBLY

FIELD OF THE INVENTION

The present invention relates to an electrical connector. More particularly this invention concerns a plug-type connector assembly suitable for use in a motor vehicle.

BACKGROUND OF THE INVENTION

A contact assembly for a plug-type connector assembly for use in automotive technology or other applications for electrical is connections mounted at the end of an electrical wire and housed in a plug-type connector assembly housing, The assembly has at least one locking clip for positioning and fixing the two parts together. Such assemblies, in addition to use in motor vehicles for hooking up the various electrical and electronic devices are also used in communication, and household appliances, or for other electrical plug-in connections.

Such known contact assemblies normally comprise a plug subassembly and a mating socket subassembly and are designed in such a way that, in addition to meeting electrical requirements such as the transmission of power and signals, they also meet mechanical requirements such as the application of transverse contact forces or electrical contacting of the wire (by means of a crimp connection or insulation displacement contact technology, for example), but also positioning and fixing the conductor of the plug in the socket. With regard to the requirements for currently known contact systems, there is a conflict between low longitudinal insertion forces during connection of the plug and socket on the one hand and high transverse contact forces (to ensure reliable contacting for power or signal current transmission) on the other hand. Namely, the enabling of low insertion forces results in low transverse contact forces, and vice versa. If the contact regions of the connector parts are coated with expensive substances such as gold or silver to avoid corrosion and thus high transition resistances, initial damage to these surfaces may result in complete system failure, particularly when very small currents or voltages are conducted through the plug-type connector assembly.

Another embodiment of a plug-type connector assembly is known from U.S. Pat. No. 6,736,682. The advantage of this known plug-in connection is that there is no terminal being mounted on the end of the electrical conductor for the wire. To absorb the plug-in forces when the plug and electrical connector are joined, both the end region of the electrical wire and the exposed electrical conductor are fixed in place by the connector housing. The embodiment according to FIG. 2 of U.S. Pat. No. 6,736,682 reliably provides strain relief for the wire by the fact that the wire is surrounded by the connector housing, in particular by extrusion coating. However, manufacture of such a design is extremely complex, since in the extrusion coating process care must be taken that the end region of the wire is completely extrusion-coated with plastic, while on the other hand the exposed electrical conductor must be only partially extrusion-coated with the plastic of the connector housing, since the electrical conductor must likewise be fixed in the connector housing, and in addition a portion of the electrical conductor must remain exposed so that electrical contact may be made with the complementary end region of the electrical conductor for the electrical connector. Such a design for a plug-type connector assembly can be implemented only with great difficulty, since coordination during the injection molding process, in particular for multiconductor plug-type connector assemblies, is extremely complicated and therefore very costly. Other systems described in German patent documents 42 35 245 and 101 02 137 and in U.S. Pat. No. 5,788,536 have similar problems.

In commonly owned U.S. patent application Ser. No. 11/654,405 filed 17 Jan. 2007 a connector assembly is disclosed having a housing formed with a passage receiving a wire having a conductive core and an insulating sheath. The housing has an end region surrounding a stripped end of the wire where the conductor is exposed and an intermediate region surround an adjacent portion of the sheath of the wire. An element in the intermediate region fixed to the sheath secures the wire in the housing against any movement relative thereto. In other words, the plug-type connector assembly housing is no longer directly molded around the end region of the wire, but instead, these means may be inserted into the passage as an additional component or components, and/or the means are molded onto the plug-type connector assembly housing, which has a one- or multi-part design. Thus, during manufacture of the plug-type connector assembly no direct interaction is necessary between the extrusion coating of the plug-type connector assembly housing and the end region of the wire, thus enabling a significantly simpler and less complicated coordination of the affected components with one another, as well as a considerable cost reduction.

OBJECTS OF THE INVENTION

It is therefore an object of the present invention to provide an improved electrical connector assembly.

Another object is the provision of such an improved electrical connector assembly that overcomes the above-given disadvantages, in particular that is adapted for motor-vehicle use and that simultaneously enables low longitudinal insertion forces and high transverse contact forces, and meets the most demanding requirements such as vibration, temperature, harmful gases, and media resistance, as well as ease of assembly for mass production.

SUMMARY OF THE INVENTION

A wire having a conductive core surrounded by an insulation sheath is fitted to an electrical connector having according to the invention a housing formed with a longitudinally extending passage and a contact part in the passage. The contact part has a front end having pair of sides adapted to flank a contact pin engaged in the passage and a rear end adapted to grip the wire with a stripped end of the conductive core extending in the front end between the sides thereof alongside the pin. An anchor lug on one of the sides engages an inner surface of the passage and retains the contact part therein. A biasing element braced between the conductive core and an opposite inner surface of the passage presses the conductive core transversely against the pin.

According to the invention, the connector part comprises a first locking part for accommodating a complementary plug-type connector assembly element and having at least one locking or anchor clip or lug, and an additional biasing part via which a transverse contact force is applied. In other words, the connector part, which may be housed in a contact passage of a plug-type connector assembly housing, comprises a first part having at least one locking clip for positioning and fixing in the plug-type connector assembly housing, and which is able to accept a mating connector part, normally a terminal pin. In one preferred and particularly simple embodiment the connector part has a one-part design, although multi-part designs are also possible. The connector part serving as a protective retaining socket is designed such that it assumes a purely mechanical function, such as, for example, a catch-lock function in the plug-type connector assembly housing. As a result of this structural design of the connector part according to the invention, the necessary low insertion forces, and thus ease of installation, do not have to be traded off against the necessary high transverse contact forces, which are essential over the service life of a vehicle. In other words, in addition to very low (practically zero) insertion forces, very high transverse contact forces and thus a highly vibration-resistant, motion-free, and robust plug-in connection may be reliably provided for very small voltages and currents, in particular less than 5 microamperes, as well as for very high voltages and currents. A further advantage is the omission of costly coated surfaces of gold or silver, for example, which in the known connector parts have been necessary to minimize contact wear and insertion forces and to increase the plug-in frequency. As a result of the very high transverse contact forces that are achievable, relative motion between the connector part and the mating connector part are avoided or essentially eliminated, thus preventing frictional corrosion and wear and therefore increases in transition resistance. The service life and reliability of such a plug-in connection are thus significantly improved compared to conventional plug-in connections.

According to one embodiment of the invention the connector part together with its biasing element for applying the transverse contact force are confined in the plug-type connector assembly housing against any relative motion with respect to the electrical wire. In other words, the connector part has a biasing element for producing the high transverse contact force in functional connection with the mating connector pin. The transverse contact forces may thus be further increased in an advantageous manner by use of this biasing element. The biasing element is formed, for example, by stamping or bending or the like from the same or different material as the connector part.

The connector part in accordance with the invention has a primary locking clip and preferably a secondary locking clip, and is securely joined to the biasing element. When the connector part is inserted into the associated contact passage of the plug-type connector assembly housing, it is positioned and fixed therein by the primary locking clip and optionally also by the secondary locking clip. These clips may be machined from the connector part, likewise by stamping and/or bending, or may be designed as an additional component which is attachable at that location.

In one refinement of the invention, the connector part has a mechanical connection in the form of a crimp formation at one end thereof, by means of which the wire is mechanically connected to the connector part. A crimped connection is therefore particularly advantageous for use in mass production, since it represents a permanent connection by the use of conventional crimping tools, thus allowing the purely mechanical functions to be realized even under tensile and pressure stresses. However, any comparable mechanical permanent connections between the wire and connector part are also possible in addition to the crimped connection. Furthermore, the connector part or socket may be designed either with or without a receptacle for a longitudinal watertight seal with respect to the plug-type connector assembly housing. This connection may be established via the wire insulation, the electrical conductor, or a combination of both.

The connector part according to the invention may be used in single- or multipole plug-type connector assemblies, and multipole plug-type connector assemblies may be configured in single or multiple rows. The electrical wires may be individual wires, ribbon cables, flat cables, or the like. The geometric region of the plug-type connector assembly housing in which the wire is inserted and also an optional sealing element are designed depending on the shape of the electrical wire.

The connector part according to the invention may be advantageously manufactured in a single- or multi-part design in a rapid and economical manner from an appropriate material in a stamping-bending process.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
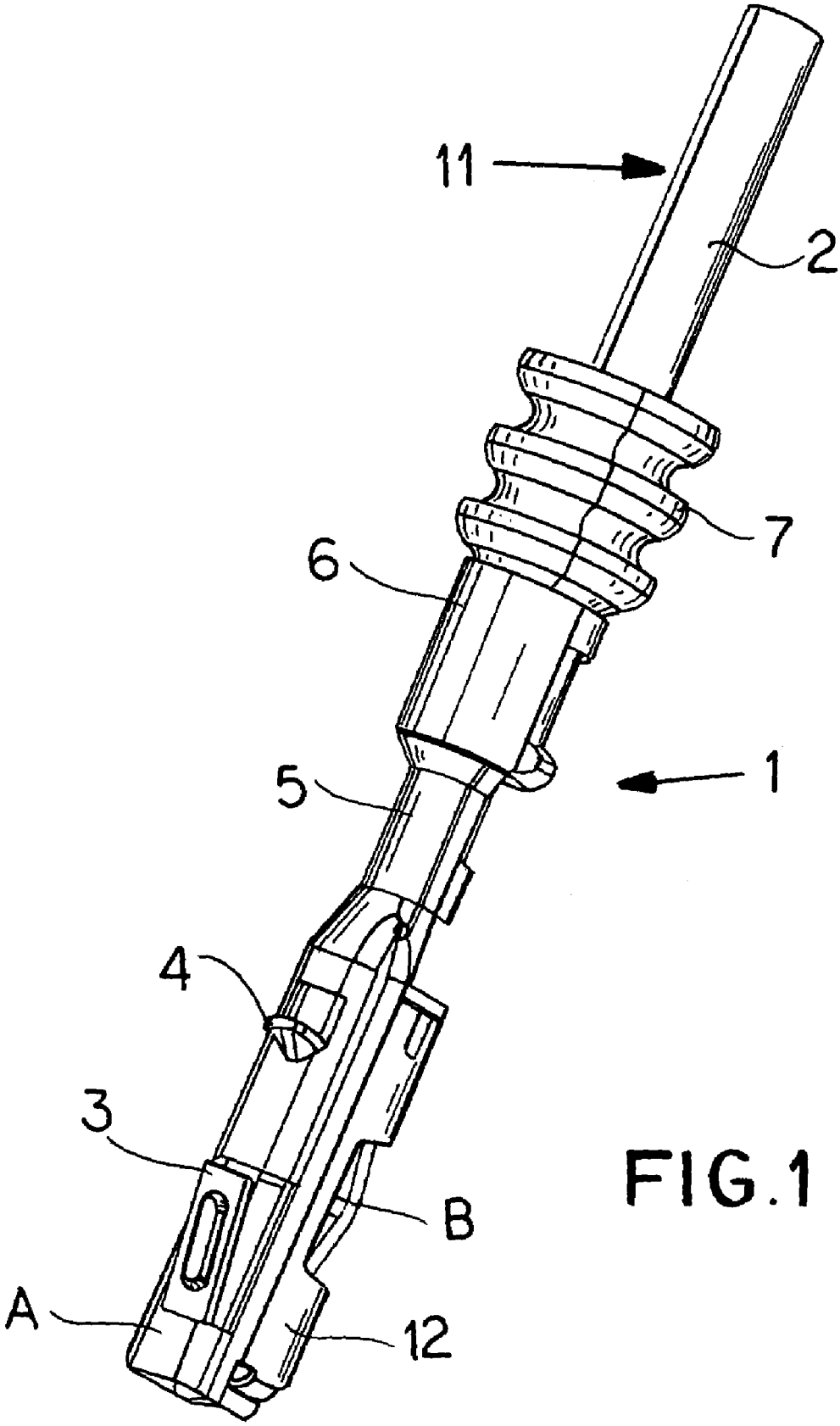
FIG. 1 is a perspective view of the plug part of the connector assembly according to the invention.
Figure 2:
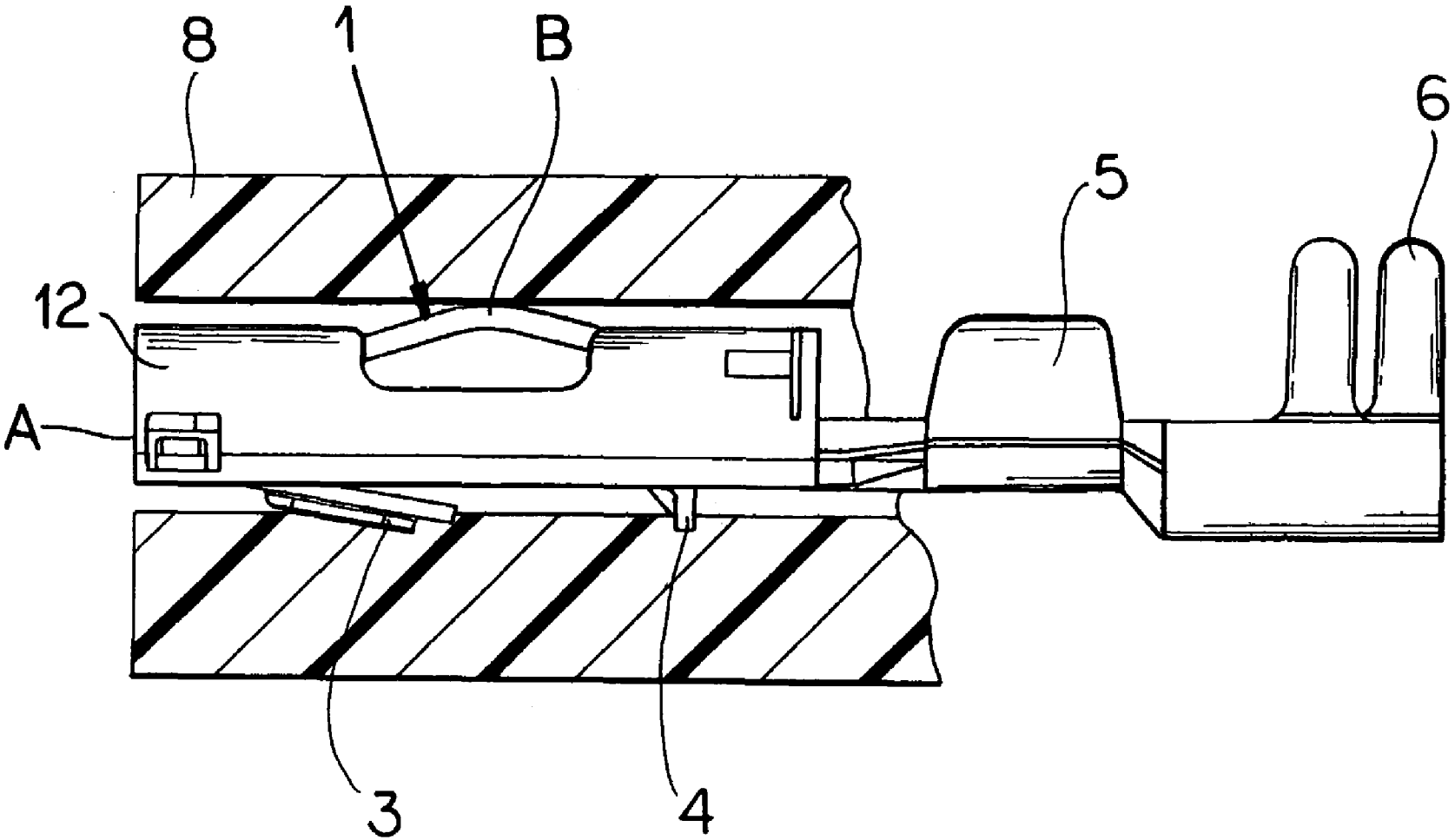
FIG. 2 is a larger-scale partly sectional view through the assembly of this invention.
Figure 3:
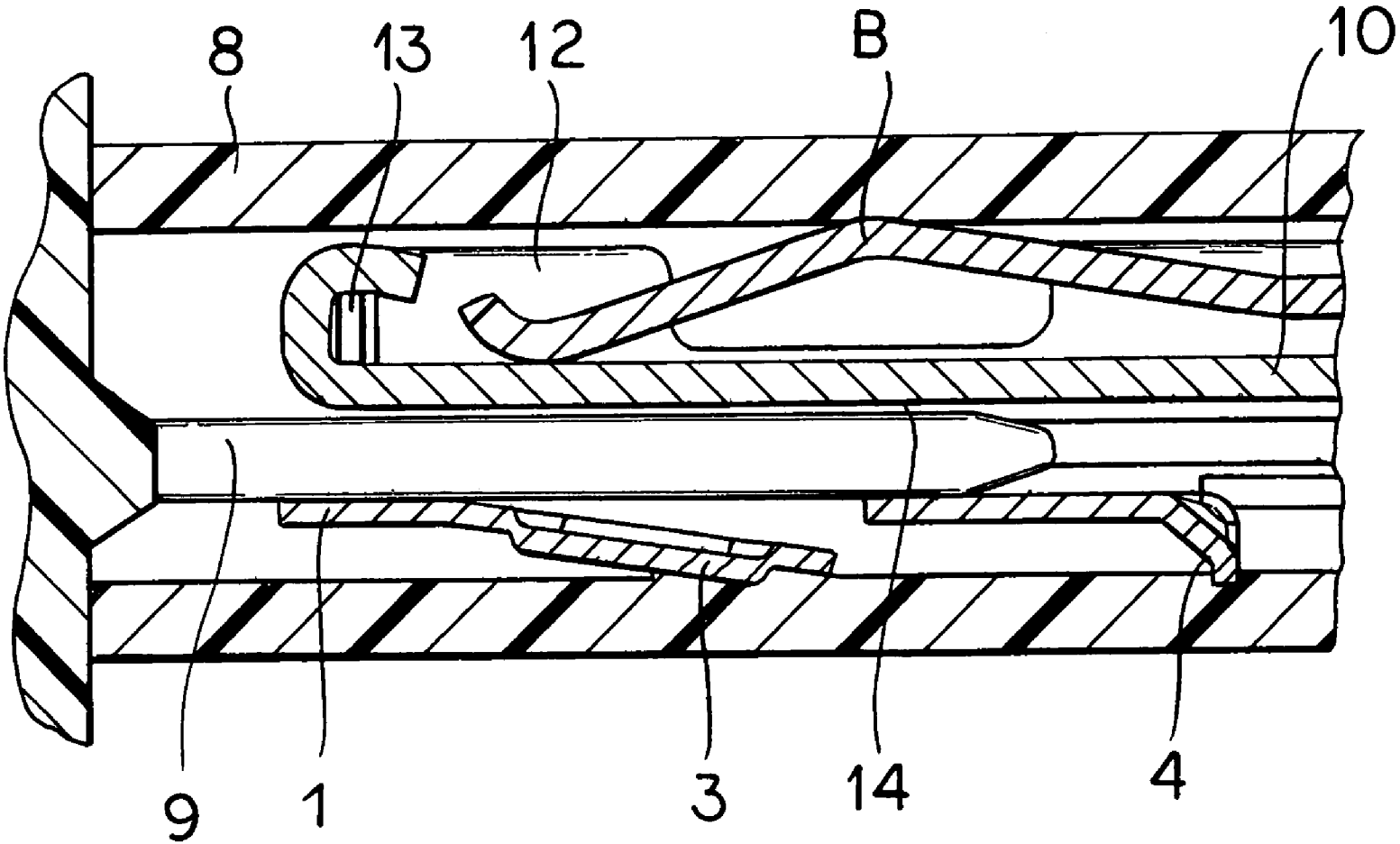
FIG. 3 is a section through the connector assembly of the present invention.

As seen in FIGS. 1 and 2 a connector part 1 for a plug-type connector assembly for use in automotive technology is mounted an electrical wire 11 having an insulation sheath 2 and a conductive core 10 (FIG. 3). The connector part 1 is elongated and of U-section to form a locking part A in turn having primary and secondary locking clips 3 and 4 and dimensioned to receive and guide a male pin or part 9 (FIG. 3) of the connector assembly element, providing a transverse connection of two side walls 12 for fixing the ends of the conductive core 9. Furthermore the cross-sectional shape provides a coding that ensures the parts will only fit together one way. The clips 3 and 4 are formed as barbs and extend from a floor 15 of the U-section locking part A.

The sheath 2 of the electrical wire 11 is connected to the connector part 1 in a mechanically nondetachable manner by means of a crimped connection 5. Outward of the crimped connection 5 along the electrical wire 11 a standard conventional single-conductor sealing crimp 6 may be present that grips a longitudinal watertight seal 7, if needed, between the outer sheath 11 of the wire 2 and the connector part 1. The sealing element 7 at least partially between the single-conductor sealing crimp 6 and the outer sheath of the wire 2, is fixed on the outer sheath 11 of the wire 2 by the single-conductor sealing crimp 6. The sealing element 7 is made of an elastically deformable material (such as rubber, elastomer, or the like), and in the longitudinal direction has a smooth, continuous surface or a ribbed design, as illustrated in FIG. 1. When the connector part 1 is inserted into the plug-type connector assembly housing, the surface of the sealing element 7 contacts the inner surface of the plug-type connector assembly housing, thereby achieving the desired longitudinal sealing. To increase the sealing effect, the cross section of the sealing element 7 is larger than the cross section of the connector part 1, so that the sealing element 7 is permanently compressed when inserted into the contact passage.

FIG. 2 shows the same connector part 1 as in FIG. 1, except that a schematic view in a housing 8 is provided, and the sealing crimp 6, which may be omitted in an unsealed variant, is shown before deformation around a wire. The plug-type connector assembly housing 8 has a contact passage for accommodating the connector part 1.

FIG. 3 shows the same connector part 1 in a sectional view together with a complementary plug-type connector assembly element 9, the electrical conductor 10 for the electrical wire 11, the locking clip 3, and the biasing element B. The core 10 is hooked at a front end of the part 1 around a transverse bridge or web 13 but extends rearward of this web 13 straight back past the biasing element B. It can be seen that the electrical conductor 10 for the electrical wire 2 has a flat shape or has been machined from a circular shape to a flat shape. In other words, in this case the electrical conductor 10, starting from a circular conductor, has been compacted. This is not necessary if the electrical wire 2 is a flat cable. Thus, the end region of the electrical conductor 10 that has been prepared or correspondingly shaped also forms an elongated contact region 14 with respect to the complementary plug-type connector pin 9. This region 14 is pressed on by the element B against one side of the pin 9 whose opposite side is thus pressed against the floor 15 of the U-section locking part 15, so that in the inserted state the compacted end region of the electrical wire 2 permanently contacts the complementary plug-type connector assembly part 9 under pressure as long as the inserted state is maintained. An excellent and relatively long surface contact is made on two sides with the pin 9.

In summary, the connector part 1 as described above provides a means for implementing plug-type connector assemblies in electrical connection technology, in particular for use in the automotive sector for high-demand applications, in which the conflicts heretofore between low insertion forces and high transverse contact forces have been resolved. In other words, mechanical and electrical requirements are met independently of one another in the proposed plug-in connection. Thus, an economical and easily customized approach is still provided. Furthermore, the protective retaining socket (connector part) according to the invention may be designed in such a way that it is suitable for unsealed variants as well as sealed variants having a single-conductor seal receptacle. The protective retaining socket is likewise provided for a primary, and optionally a secondary, locking clip in the plastic housing for the plug-type connector assembly. The pressure spring or biasing element in general is also integrated into the protective retaining socket for the transmission of transverse contact force.

We claim:

1. In combination with a wire having a conductive core surrounded by an insulation sheath, an electrical connector comprising:

a housing formed with a longitudinally extending passage; and a contact part in the passage and having a front end having pair of sides adapted to flank a contact pin engaged in the passage and a rear end adapted to grip the wire with a stripped end of the conductive core extending in the front end between the sides thereof alongside the pin;

an anchor lug on one of the sides engaging into an inner surface of the passage and retaining the contact part therein; and a biasing element braced between the conductive core and an opposite inner surface of the passage and pressing the conductive core transversely against the pin.

2. The connector defined in claim 1 wherein the conductive core is longitudinally anchored in the front end.

3. The connector defined in claim 1 wherein the front part has two such anchor lugs spaced longitudinally apart.

4. The connector defined in claim 1 wherein the stripped core is flattened.

5. The connector defined in claim 1 wherein the front part is formed with a cross web around which the stripped core is hooked.

6. The connector defined in claim 1 wherein the front end is generally U-shaped with a floor formed with the anchor lug and a pair of generally parallel side walls, the biasing element being between the side walls and spaced from the floor.

7. The connector defined in claim 6 wherein the biasing element is formed unitarily of sheet metal with the side walls and floor.

8. The connector defined in claim 7 wherein the biasing element is a generally longitudinally extending tongue.

9. The connector defined in claim 1 wherein the rear end is provided with a front crimp engaged around the stripped core.

10. The connector defined in claim 9 wherein the rear end is provided with a rear crimp engaged around the sheath of the wire.

11. The connector defined in claim 10, further comprising an elastomeric seal sleeve engaged between the rear crimp and the sheath and tightly fitting in the passage.

* * * * *